United States Patent [19]

Hirschburger

[11] 4,442,573

[45] Apr. 17, 1984

[54] DEVICE FOR INTERMEDIATE STORAGE OF THREAD

[76] Inventor: Kurt Hirschburger, Der Schöne Weg 90, D-7410 Reutlingen, Fed. Rep. of Germany

[21] Appl. No.: 297,537

[22] Filed: Aug. 31, 1981

[30] Foreign Application Priority Data

Sep. 9, 1980 [DE] Fed. Rep. of Germany ..... 3033827

[51] Int. Cl.[3] ..... D02G 1/16; B65H 51/20

[52] U.S. Cl. ..... 28/271; 28/281; 242/47.13; 242/18 CS

[58] Field of Search ..... 242/47.13, 47.12, 47.01, 242/47, 82, 83; 28/281, 289, 271; 68/5 C, 5 D

[56] References Cited

U.S. PATENT DOCUMENTS

| | | | |
|---|---|---|---|
| 2,268,866 | 1/1942 | Furness | 242/47.13 |
| 3,309,855 | 3/1967 | Stoll et al. | 28/271 X |
| 3,683,650 | 8/1972 | Hirschburger | 242/47.12 X |
| 3,812,668 | 5/1974 | Wilson | 28/271 X |
| 4,122,588 | 10/1978 | Borenstein et al. | 28/281 X |
| 4,304,366 | 12/1981 | Enneking et al. | 242/47.13 X |
| 4,316,370 | 2/1982 | Steiner | 242/47.13 X |

FOREIGN PATENT DOCUMENTS

| | | | |
|---|---|---|---|
| 550811 | 8/1933 | Fed. Rep. of Germany . | |
| 1925315 | 11/1970 | Fed. Rep. of Germany . | |
| 2411644 | 9/1975 | Fed. Rep. of Germany | 242/47.01 |
| 2338703 | 5/1979 | Fed. Rep. of Germany . | |
| 2837183 | 3/1980 | Fed. Rep. of Germany . | |
| 2205371 | 5/1974 | France . | |

*Primary Examiner*—Stanley N. Gilreath

*Attorney, Agent, or Firm*—James Creighton Wray

[57] ABSTRACT

A device for intermediate storage of thread having the following: a belt conveyor, a drive mechanism, a winding head, having a thread guide arranged along a circular path, through which thread, in the form of loops, is placed upon the front portion of the belt conveyor, in the feed direction, and having a device for taking off the thread at the rear section of the belt conveyor, also having a drive member for activating belt conveyor, which member is rotating in the feed direction and is coupled with conveyor belt, of belt conveyor, or is coupled with a drive member connected thereto through the area defined by the loops. The device can easily be realized mechanically.

2 Claims, 7 Drawing Figures

DEVICE FOR INTERMEDIATE STORAGE OF THREAD

This invention refers to a device for intermediate storage of thread, consisting of a belt conveyor with a drive mechanism, a rotatably mounted winding head with a thread guide on a circular path through which thread in the form of loops, in the manner of helical turns, is laid upon the front area of the belt conveyor in the feed direction, and having a device for taking off the thread at the rear of the belt conveyor.

Such a device is known from German OS No. 19 25 315. In this conventional device the drive of the belt conveyor is actuated by a motor arranged outside the belt conveyor and requires a complex gear drive. The belt conveyor is held by a support pole arranged therein, extending in parallel direction to the transport, and the complex gear drive simultaneously serves as a mounting for the pole. The objective of this invention is improvement and simplification of such conventional devices.

This objective is achieved by the present invention in that actuation of the conveyor belt is provided by a drive element which is rotatably actuated in feed direction of the belt conveyor and which is in communication with the feed belt of the belt conveyor or in communication with a segment coupled thereto through the area defined by the loops.

The advantage of the invention resides in the fact that no gear drive is necessary within the mounting of the belt conveyor's central shaft, as the drive force for the feed belt, in the simplest case, is directly transferred to the conveyor belt. The invention shall also comprise a transfer of the drive force by magnetic forces, thus the feed, belt, could, for instance, consist of non-magnetic material having spaced ferromagnetic segments which might be moved by one or several rotatably mounted magnets. Another variation is actuated by way of a linear motor whereby, for example, the feed belt consists of metal. The preferred variation, however, is the one in which the drive member has mechanical contact with the belt conveyor and whereby the moving speed of the drive member in the transfer direction essentially corresponds to the transport speed of the belt conveyor. Any difference in speed which might possibly occur between the belt conveyor and the drive member would be relatively low, and no harm is done if the loops placed onto the belt conveyor bodily contact the drive member. If care is taken that the interval during which such contact may occur remains relatively short, even a more substantial differential in speed can be tolerated, which, due to the short time in which it is effective, will not lead to disturbance or even damage of the laid upon loops. If the drive member is in direct contact with the conveyor belt, apart from a possibly occurring slippage, there will generally be no speed difference. A difference in speed between the drive member and the actuated part, however, is permissible, if, as pointed out later, the actuating member is in contact with a drive roller arranged within the area defined by the loops.

Although the inventive device embraces positive contact between the drive member and the part actuated by it, in the preferred variation of the invention, the mechanical contact is by a friction contact. In this variation of the invention, the arrangement can be such that the part being contacted by the thread loops, i.e. the drive member and the part actuated by it, will have no projecting parts into which the thread loops could hook in the event of operational disturbance.

In still another variation of the invention, the drive member has a linear movement. Thus, the drive member may execute a traversing movement, whereby in one moving direction the drive member is brought to rest at the feed belt, and in the reverse direction is being lifted off. In another variation of the invention, however, the drive member is rotatable and specifically in the form of a wheel. However, the rotating drive member could also be along the lines of a feed belt, as its entire length essentially is in communication with the run of the feed belt of the belt conveyor which holds the loops. The term wheel may be construed as being a shaft, i.e. a wheel with substantial thickness measured in axial direction.

In still another variation of the invention, the wheel is coupled with a friction wheel which is arranged within the inside of the loops and is in drive connection with the feed belt. Preferably, the contact zone between the wheel and the friction wheel is approximately within the area defined by the loops. Thus, there is no force through the individual loops in the area of the contact zone, which might cause a stretching of the individual loops. Such stretching does not necessarily have to lead to thread damage or impairment of a treatment step, being carried out with the aid of the inventive device, as for instance a shrinking or steaming process step.

In a further variation of the invention, the wheel is in contact with the feed belt, and the feed belt is supported at the side facing away from the wheel within its region. In this way, the wheel can exert sufficiently strong contact pressure against the feed belt to ensure activation of it by way of friction forces. Thus, the peripheral speed of the wheel, except for a slippage, is equal to the transport speed of the feed belt, so that the position of the thread loops being located between the wheel and the feed belt will be only slightly altered, if at all. The only effect upon the thread is a short-term gripping between the feed belt and the wheel. Such temporary compression, however, impairs the thread to the minutest degree, if at all.

When the thread to be laid up on the belt conveyor is not on a storage spool located at the winding head itself, but for example, if fed from outside the device, it is laid up upon the belt conveyor by a rotating transfer tube, as is the case in the conventional device, and it is not possible to firmly mount the shaft holding the belt conveyor in a secure manner to prevent rotating of the belt conveyor. The secure mounting of the shaft in the conventional device is effected by using a planetary gear, which also serves to activate the belt conveyor itself. According to one variation of the invention, safeguarding against a pivoting of the belt conveyor, as opposed to the conventional device, is simplified in that the belt conveyor is mounted in a manner which provides rotation around its longitudinal axis, and in that a support extending from the outside, in the area of the loops, prevents pivoting of the belt conveyor around the longitudinal axis. The generally rotatable mounting of the belt conveyor is necessary in order to provide the just mentioned rotating transfer tube. The support again comes into contact with the loops of the thread, whereby, however, a disturbance of the position of the loops or a damage of the thread is avoided if this support is designed in the manner as described above, by way of several examples for the drive member. The arrangement is particularly easy to realize when the support, according to one variation of the invention, has at least one support wheel whose rotational axis runs transverse to the feed direction of the belt conveyor. This support wheel itself does not need to be activated, it should, however, be mounted with sufficiently easy action.

According to a variation of the invention, the rotatingly activating wheel which is provided for the drive of the belt conveyor is simultaneously the support wheel. The rotatingly activating wheel may be located at any location within the longitudinal path of the belt conveyor since it, as previously described, merely serves to prevent a pivoting of the belt conveyor around its longitudinal axis.

According to one variation of the invention, the weight of the belt conveyor is, at least partially, borne by a support extending from the outside in the area of the loops. This support may be designed in the same manner as the various versions of the drive member described above. A preferred version is where the drive member simultaneously forms the support to prevent pivoting of the belt conveyor around its longitudinal axis and moreover acts as a support for absorbing part of the weight of the belt conveyor. Here, the drive wheel, which advantageously is in the form of a drive shaft is in the area of the rear portion of the belt conveyor from the feed direction.

The described device finds particular application in a texturing device for thread, in which the thread initially is fed to a texturing device, particularly an air texturing device, and subsequently undergoes a temperature treatment for setting. This temperature treatment is carried out on the device described above, which for this purpose, is surrounded by a housing in order to maintain the desired temperature within the area of the thread loops. The particular advantage of the application is in fact that a significant dwell time of the thread with a relatively short length of the device can be achieved during the temperature treatment, so that a sure setting of the texturing is possible.

Further features and advantages of the invention are evident from the following description of an example of the invention by way of the drawing, which shows essential inventive details, and from the subsequent claims. The individual features may singly or in combination be realized in any variation of the invention.

Figure 1:
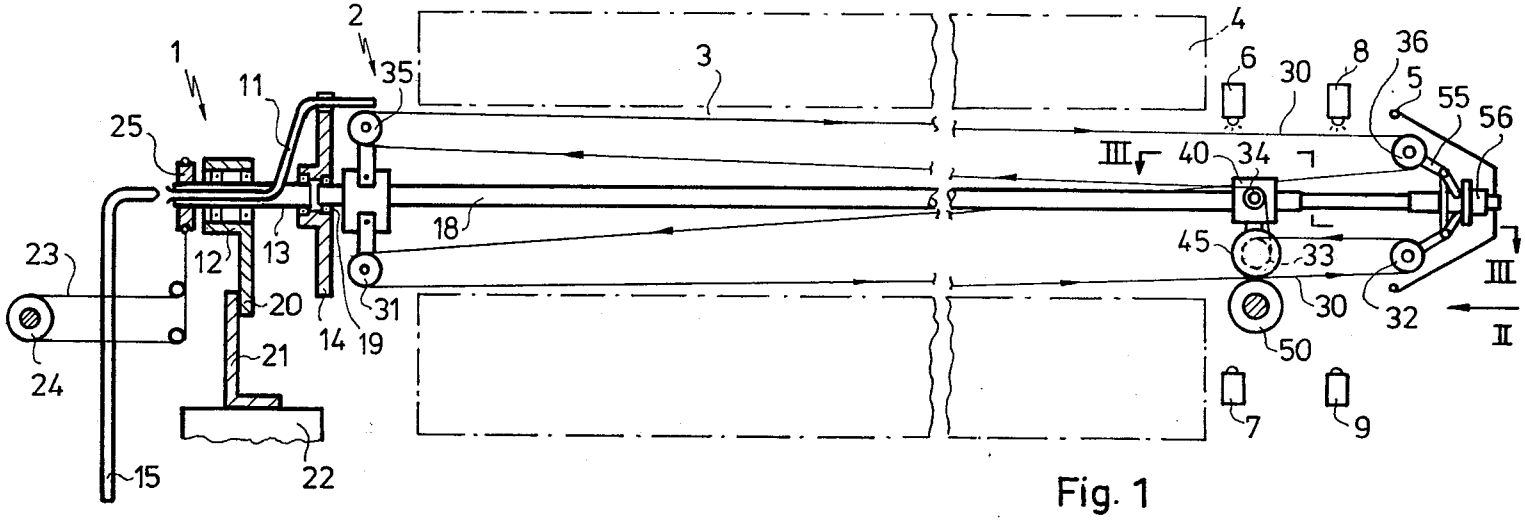
FIG. 1 is a side view of an example of the intermediate storage unit for thread, whereby the activation of the belt conveyor is from the outside by way of a drive shaft.

The device depicted in FIG. 1 comprises a winding head 1, joined to which there is belt conveyor 2 passing through a treatment zone 3 which is bordered by housing 4 indicated by dash-dotted line surrounding the treatment zone. At the free end of belt conveyor 2, facing away from winding head 1, the thread laid upon by winding head 1 is pulled off via a take-off ring 5. Two light barriers 6,7 and 8,9 ensure that the end of the helical winding of the thread on the belt conveyor 2 remains continuously in the region between these light barriers. To this end, the take-off speed is being accordingly adjusted to meet this objective.

Winding head 1 has feed tube 11, which is rotatably mounted by way of support tube 13 located in bearing 12, rotatable around a horizontal axis, whereby the left end of feed tube 11 is exactly in the rotational axis, and the right end is offset from the rotational axis and is held by support disk 14 rotating with support tube 13. The thread, not depicted in FIG. 1, is injected into feed tube 11 via injection tube 15 and is being laid upon the belt conveyor during its rotational movement in the form of loops, which because of the simultaneous transport movement of the belt conveyor, assume the form of a helical turn. Belt conveyor 2 has a horizontal central shaft 18 formed by the tube whose left end depicted in FIG. 1 is rotatably mounted in support disk 14 by way of ball bearings 19. In this way, the left end of shaft 18 is supported at a fixed base 22 via support disk 14, support tube 13, bearing 12 and support brackets 20, 21. Feed tube 11 is activated in the indicated manner via belt drive 23 which transfers the rotational movement of drive shaft 24 to a wheel 25 connected with feed tube 11. Belt conveyor 2 has two feed belts 30 and 30′ which in the sight line of FIG. 1 are equally spaced in series. Thus it suffices to explain the course of belt 30. Slightly ascending, it runs from front lower roller 31 to rear lower roller 32, where it is deflected and returns above the belt segment just described. Then it is being guided around roller 33 by approximately 270°, which in the sight line of FIG. 1 is behind the position of roller 32. From roller 33, the belt reaches upward to roller 34 located somewhat further back, viewed from the sight line of FIG. 1. From roller 34, slightly ascending, it travels to roller 35 at the front which deflects the belt by approximately 180° from where, slightly descending, it reaches a rear upper roller 36. Roller 36 is above roller 32, and from there it again reaches the rear lower roller 31. The direction of belt travel is from roller 31 to roller 32, and thus also from roller 35 to roller 36. The course of belt 30′ is identical. The belt segments in FIG. 1, moving from the front, i.e. from the left, to the rear, lie at the corners of a rectangular prism and the thread loops wound upon these belts, moving to the front, are sufficiently tightly wound to prevent sagging and are within the area of the prism, which in cross section is slightly tapered.

Figure 2:
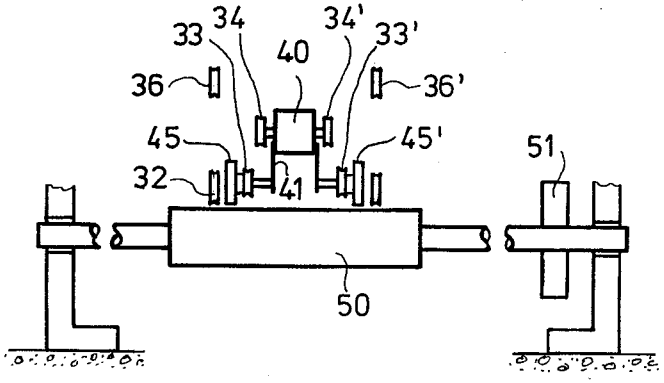
FIG. 2 is a simplified front view in the direction of the arrow at II in FIG. 1.

As shown in FIG. 2, roller 34 and corresponding roller 34′ of belt 30′ are attached to block 40 which is directly fastened to shaft 18. Block 40 has downwardly reaching extensions 41 to which roller 33 or roller 33′ are rotatingly attached. Friction wheel 45 is connected to roller 33 in coaxial and fixed manner and reached, with its circumference at its underside, the two belt segments running between lower rollers 31 and 32 of belts 30 and 30′. A cylindrical wheel 50, which is permanently fixed in the manner indicated and is activated via belt pulley 51, presses against friction wheel 45 from below. Wheel 50, in the direction of its rotational axis runs at a right angle to the sight view of FIG. 1, i.e. horizontal, and is long enough that it engages both friction wheel 45 of feed belt 30 as well as friction wheel 45′ of feed belt 30′, disposed towards friction wheel 45 in a mirror inverted manner. In this manner, the rotatably mounted shaft with its left end in support disk 14

(FIG. 1) with the belt conveyor connected thereto, is prevented from pivoting around its horizontal longitudinal axis. Friction wheel 45, by the weight of belt conveyor 2, to the extent that it has not been absorbed by bearing 12, is pressed against wheel 50. The friction force between wheel 50 and friction wheels 45, 45' is such that the rotational movement of wheel 50 initiates movement of friction wheels 45, 45' and thereby activates feed belts 30, 30'. In the contact zone between friction wheels 45, 45', there are lower horizontal segments of the thread loops layed on to the belt conveyor, which are not moved from their position due to the fact that the relative speed between wheel 50 and friction wheels 45, 45' amounts to practically zero. These thread loops run along between friction wheel 45 and wheel 50 in feed direction of the belt conveyor. The diameter of friction wheel 45 is approximately as large as that of roller 33 or differs only slightly, so that the circumferential speed of wheel 50 corresponds to the transport speed of the belt conveyor.

Contrary to conventional designs, the shaft need not be of cantilever construction. As the right end portion of the shaft (in FIG. 1) is also supported by roller 50, friction wheels 45, 45' and block 40 with extensions 41, it consequently may be of simple and light-weight construction. The support described which leaves the end of the belt conveyor free, permits removal of the thread by way of a simple take-off ring.

In the manner indicated in FIG. 1, rear rollers 32 and 36 are attached to two-armed bracket 55 so that the rollers may be tilted inwardly or outwardly by way of adjusting screw 56, attached to the end of shaft 18, (in FIG. 1, this would be in approximately a vertical direction from top to bottom). in order to tighten the feed belts or to adjust the direction of the feed belts between rollers 31 and 32 or 35 and 36, respectively for insignificant deviation from the horizontal line.

Figure 3:
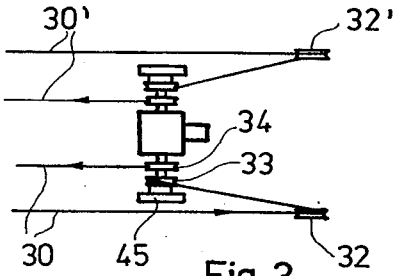
FIG. 3 is a simplified view corresponding to line III—III in FIG. 1.
Figure 4:
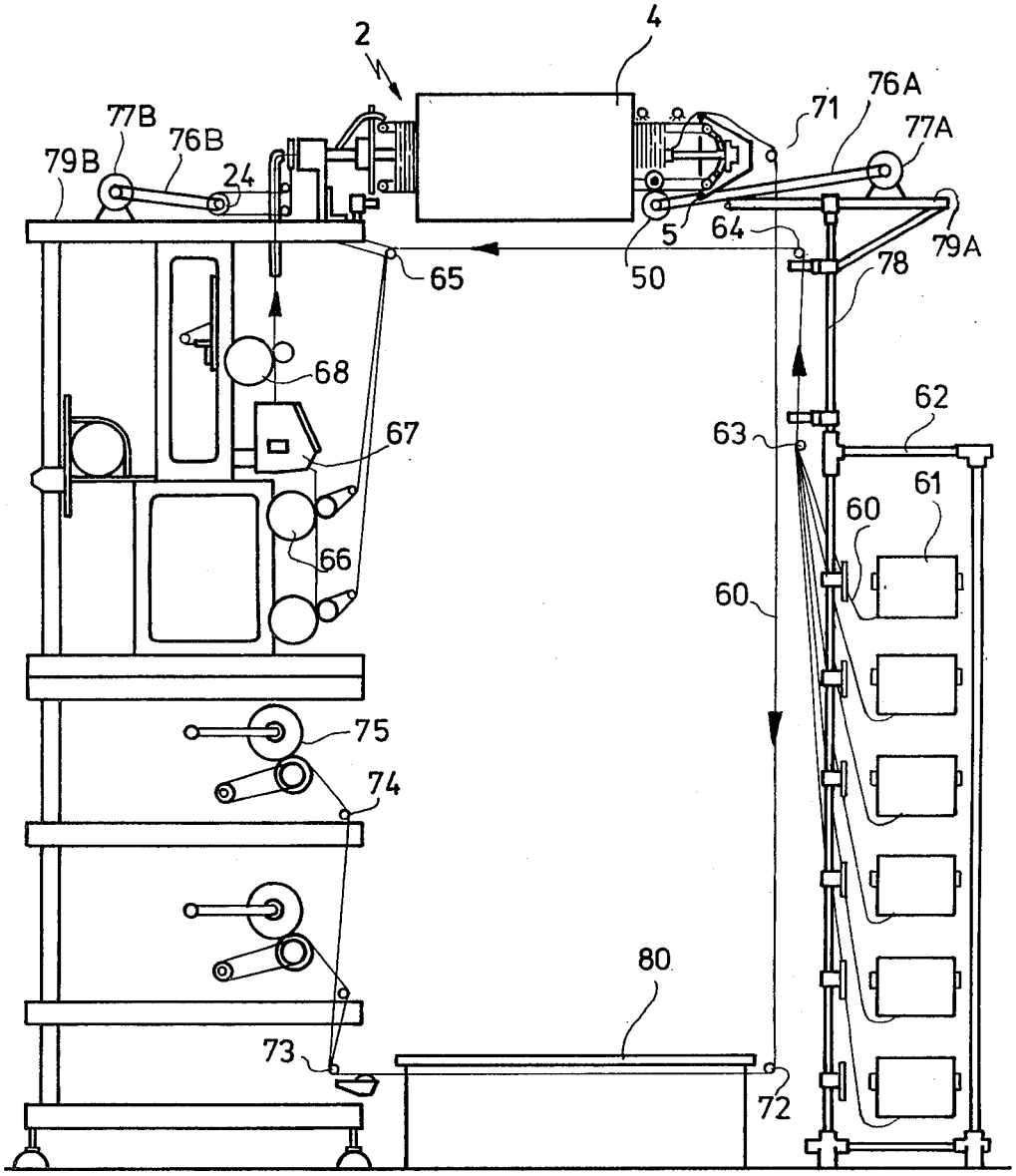
FIG. 4 is a side view of a texturing machine comprising the device according to FIG. 1.

In FIG. 4, the above device is part of a texturing machine. Thread 60 travels from a take-off spool 61 contained in creel 62, which has numerous take-off spools, via several thread guides 63, 64, 65 to a delivery system 66 from where it reaches texturing jet 67. This jet is contained in a housing visible in FIG. 4. Upon leaving the texturing jet, the thread reaches injection tube 15 of the thread storage device (shown in FIGS. 1–3) via a delivery system 68. The thread storage device is part of a fixation chamber in which the thread is being set. FIG. 4 shows the individual thread loops on the belt conveyor. The thread is being taken off at the end of the belt conveyor via rigid take-off ring 5 and travels to a spool device 75 via thread guides 71, 72, 73, 74.

Additional delivery systems, spool devices as well as take-off spools depicted in FIG. 4 are in communication with more fixation chambers (not depicted) which are located behind the fixation chamber illustrated. The thread storage belt conveyor 2 and housing 4 are mounted at the upper end portion of a machine frame 78 which contains the individual elements of the texturing machine just described. The thread storage, due to its light weight can be accomodated at the indicated location without difficulty, thereby leaving a service passage which is accessible via a work aisle 80, below which the thread is passing between thread guide returns 72 and 73. Shaft 24 and wheel 50 are activated via belt 76A or 76B, respectively, by drive motors 77A or 77B, which stand on platforms 79A or 79B, respectively.

Figure 5:
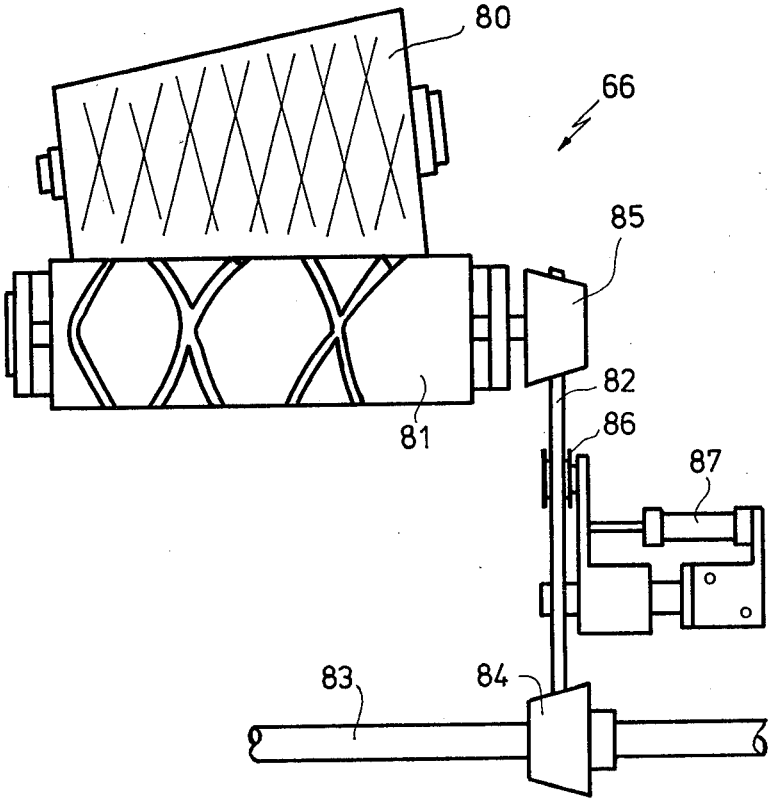
FIG. 5 is a side view of a winding device whose winding speed can be regulated.

Winding device 66 is adapted for winding of a cone spool. As shown in FIG. 5, the device has a grooved cylinder 81 activating winding spool 80. Grooved cylinder 81 is actuated by belt 82 which is communicating with a cone-shaped belt pulley 84 keyed to shaft 83, and with cone-shaped belt pulley 85, connected with grooved cylinder 81 in a secure manner, and whereby the direction of the cones on pulleys 84 and 85 are opposite.

A belt guide 86 is adjustable by means of a hydraulic cylinder 87, so that upon displacement to the right, belt 82 interacts with a relatively small diameter of pulley 85 and a relatively large diameter of pulley 84; and upon displacement to the left end position, there is interaction with a relatively large diameter of pulley 85 and a relatively small diameter of pulley 84, which affords a variable gear ratio of the belt drive. Adjustment of hydraulic cylinder 87 is controlled by light barriers 6, 7, 8, 9 in such a way that the right end of the helical turns of the thread on the belt conveyor in FIG. 1 always remains between the light barriers.

Figure 6:
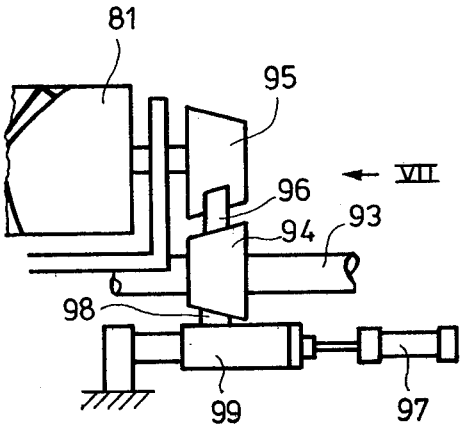
FIG. 6 is a side view of a different version of the winding device, partially fragmented.
Figure 7:
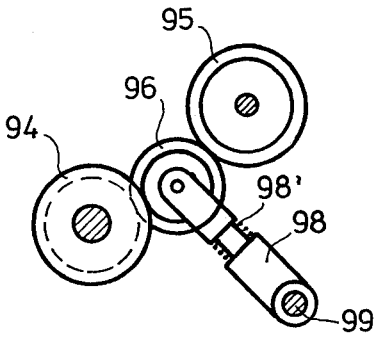
FIG. 7 is a view in the direction of arrow VII in FIG. 6.

FIG. 6 shows another variation of a variable gear ratio between a shaft 93 relating to shaft 83 to which there is keyed on a pulley 94 corresponding to pulley 84, and a pulley 95 corresponding to pulley 85. Instead of a belt, there is provided a friction wheel 96 attached to telescopic guide 98, which is kept in constant mesh with pulleys 94 and 95 by spring 98'. The telescopic guide 98 itself is attached at adjustable bar 99 which is adjustable by way of hydraulic cylinder 97 corresponding to cylinder 87 in its longitudinal direction (in FIG. 6, in horizontal direction). Here too, the displacement of friction wheel 96 causes a change in the gear ratio.

A chamber length of 0.5 m, and a loop length of 0.5 m and a lay distance of the individual thread loops of 0.3 mm, assuming a thread speed of 400 m/min., result in an approximate 2 minutes stay for the thread in the treatment chamber of the thread storage.

The device described is particularly suited for treatment of threads that have a burr effect, i.e. adhere to a greater or lesser extent to segments of the same thread. The device can be operated in such a way that the individual thread loops do not come into contact with each other on the conveyor device, thus eliminating disturbance of the operation by the so-called burr effect. The expression belt conveyor is to be understood to also utilize a rope or rope-like conveying means instead of the feed belt.

I claim:

1. A device for intermediate storage of thread comprising a belt conveyor, a winding head having a thread guide arranged along a circular path through which the thread, in the form of loops, is laid upon a front area of the belt conveyor moving in a feed direction, and having a device for taking off the thread at a rear area of the belt conveyor, wherein there is provided a rotating drive member for activating the belt conveyor, which member rotates in said feed direction, in frictional contact with the belt conveyor, the moving speed of the drive member in said feed direction of the belt conveyor essentially corresponding to the moving speed of said belt conveyor in said feed direction, wherein the belt conveyor is arranged horizontally and is provided with a horizontal shaft, the weight of the belt conveyor being at least partially borne by the drive member which braces support means connected to the horizontal shaft and arranged within the inside of the loops, and whereby the belt conveyor is arranged around the shaft and extends essentially in longitudinal direction of the shaft, and wherein the winding head is positioned at one end of the shaft and wherein the winding head lays thread loops upon the conveyor in such a way that during operation of the device at least part of the length of the shaft is located inside the thread loops, wherein the belt conveyor is mounted in a manner providing rotation around its longitudinal axis and wherein the rotating drive wheel forms a support extending from the outside within the area of the loops, which support prevents pivoting of the belt conveyor around its longitudinal axis.

2. A texturing machine comprising a texturing jet, a take-off spool containing thread, first delivery means for delivering thread from the take-off spool to the texturing jet, thread storage means for intermediate storage of thread, second delivery means for feeding thread from the texturing jet to the thread storage means, and spooling means for spooling thread taken from the thread storage means, said thread storage means comprising a belt conveyor with drive mechanism, a winding head having a thread guide arranged along a circular path through which the thread, in the form of loops, is laid upon a front area of the belt conveyor moving in a feed direction, and having a device for taking off the thread at a rear area of the belt conveyor, a rotating drive roller for driving the belt conveyor, said roller rotating in said feed direction and in friction contact with a feed belt of the belt conveyor or with a driving member connected thereto through the area defined by the loops, the moving speed of the drive roller in said feed direction of the belt conveyor essentially corresponding to the moving speed of said belt conveyor in said feed direction, wherein the belt conveyor is arranged horizontally and is provided with a horizontal shaft, the weight of the belt conveyor being at least partially borne by said drive roller which braces support means connected to the horizontal shaft and arranged eithin the inside of the loops, wherein the conveyor is arranged around the shaft and extends essentially in longitudinal direction of the shaft and wherein the winding head lays the thread loops on the conveyor in such a way that during operation of the device at least part of the length of the shaft is located inside the thread loops wherein the belt conveyor is mounted in a manner providing rotation around its longitudinal axis and wherein the rotatable drive roller extends from the outside within the area of the loops, and prevents pivoting of the belt conveyor around its longitudinal axis, and loops, and further comprising a housing surrounding the belt conveyor to define a treatment zone for setting the thread.

* * * * *